US007674218B2

(12) United States Patent
Evans et al.

(10) Patent No.: US 7,674,218 B2
(45) Date of Patent: Mar. 9, 2010

(54) FILTER COMPONENT CUTTING SYSTEM

(75) Inventors: James D. Evans, Chesterfield, VA (US); Steven R. Rinehart, Chesterfield, VA (US); G. Robert Scott, Midlothian, VA (US); Steven F. Spiers, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 495 days.

(21) Appl. No.: 11/646,990

(22) Filed: Dec. 28, 2006

(65) Prior Publication Data

US 2008/0156337 A1 Jul. 3, 2008

(51) Int. Cl.
*B31C 99/00* (2006.01)

(52) U.S. Cl. ..... 493/45; 493/39; 83/161

(58) Field of Classification Search ..... 493/39, 493/42, 45, 46, 50; 83/161, 162, 23, 410, 83/150

See application file for complete search history.

(56) References Cited

U.S. PATENT DOCUMENTS

| | | | | | |
|---|---|---|---|---|---|
| 2,779,338 | A * | 1/1957 | Himoff | 131/72 |
| 3,158,251 | A * | 11/1964 | Skala et al. | 198/434 |
| 3,164,243 | A * | 1/1965 | Schubert et al. | 198/450 |
| 3,308,832 | A * | 3/1967 | Stelzer et al. | 131/94 |
| 3,308,833 | A * | 3/1967 | Dearsley | 131/94 |
| 3,487,754 | A * | 1/1970 | Jorn | 493/42 |
| 3,664,891 | A * | 5/1972 | Schubert et al. | 198/428 |
| 3,768,353 | A * | 10/1973 | Milner | 83/161 |
| 3,791,265 | A * | 2/1974 | Westcott et al. | 493/42 |
| 3,815,612 | A * | 6/1974 | Molins | 131/94 |
| 3,887,059 | A * | 6/1975 | Verjux | 198/450 |
| 3,958,498 | A * | 5/1976 | Payne | 493/4 |
| 4,040,430 | A * | 8/1977 | Molins | 131/94 |
| 4,321,050 | A * | 3/1982 | Oesterling | 493/45 |
| 4,385,536 | A * | 5/1983 | Hall | 82/52 |
| 4,483,349 | A * | 11/1984 | Dyett et al. | 131/94 |
| 4,823,932 | A * | 4/1989 | Hinz | 198/450 |
| 4,943,272 | A * | 7/1990 | Hirose et al. | 493/45 |
| 5,928,124 | A * | 7/1999 | Gherardi et al. | 493/459 |
| 7,226,404 | B2 * | 6/2007 | Rizzoli et al. | 493/48 |
| 7,338,421 | B2 * | 3/2008 | Eusepi et al. | 493/39 |
| 7,435,208 | B2 * | 10/2008 | Garthaffner | 493/39 |

FOREIGN PATENT DOCUMENTS

| | | |
|---|---|---|
| DE | 1170298 | 5/1964 |
| GB | 924126 | 4/1963 |
| GB | 1029127 | 5/1966 |

* cited by examiner

*Primary Examiner*—Paul R Durand
(74) *Attorney, Agent, or Firm*—Connolly Bove Lodge & Hutz LLP

(57) ABSTRACT

A filter component cutting system comprises a supply hopper of elongate filter rods and a cutting drum with spaced apart flutes on an exterior surface of the drum for receiving the elongate filler rods. A transfer mechanism receives the elongate filter rods from the supply hopper and delivers the rods to the flutes on the cutting drum. At least one cutter adjacent the cutting drum functions to cut the filter rods in to individual filter components as the cutting drum rotates.

13 Claims, 5 Drawing Sheets

FILTER COMPONENT CUTTING SYSTEM

BACKGROUND OF THE INVENTION

The present invention relates to a filter component cutting system for producing individual filter components for use in filter constructions for cigarettes.

In many instances wrapped tobacco rods are connected to filter constructions of one type or another in the manufacture of cigarettes. Filter constructions often include individual filter components comprising one or more plugs of cellulose acetate through which tobacco smoke passes during the smoking process. In some instances cellulose acetate is used alone in the filter construction, and in other instances cellulose acetate plugs are used in combination with other material such as particulates of activated carbon and silica gels, for example. Compound filters such as plug-space-plug filter constructions may include spaced apart cellulose acetate plugs that define a space or cavity filled with particulate material.

Cellulose acetate filter components are often cut to size from longer stock material, and the present invention is directed to machines and processes that perform the cutting operation.

SUMMARY OF THE INVENTION

Accordingly, one of the objects of the present invention is a filter component cutting system that functions to cut filter components from longer stock material and delivery them single file to a filter combining operation.

Another object of the present invention is a filter component cutting system that includes a cutting drum that cut filters from longer stock material into accurate length components.

Still another object of the present invention is a cutting drum that allows quick and easy adjustment of filter component length.

In accordance with the present invention, a filter component cutting system comprises a supply hopper of elongate filter rods, and a rotating cutting drum with spaced flutes on an exterior surface of the drum arranged to receive the filter rods. A transfer mechanism receives filter rods from the supply hopper and delivers the rods to the flutes on the cutting drum. At least one cutter blade is positioned adjacent the cutting drum for cutting the elongate filter rods into individual filter components as the cutting drum rotates.

Preferably the filter component cutting system includes a stop at one end of each of the flutes on the cutting drum against which the elongate filter rods are positioned prior to being cut into individual filter components. Each stop may be adjustable within its respective flute depending upon the desired length of the individual filter components.

A vacuum assist on the cutting drum functions to position the elongate filter rods adjacent the stops prior to being cut into individual filter components.

The transfer mechanism may comprise a pair of cooperating fluted vacuum drum, and in one embodiment of the present invention the pair of cooperating fluted vacuum drums and the cutting drum each have a horizontal axis of rotation. In another embodiment of the invention the transfer mechanism comprises a single fluted vacuum drum, and the single fluted vacuum drum and the cutting drum each have a horizontal axis of rotation.

In still another embodiment of the invention the transfer mechanism comprises a single fluted vacuum drum having a horizontal axis of rotation and a bevel transfer drum, and in this embodiment the cutting drum has a vertical axis of rotation.

The cutter blade may comprise a single bade or a plurality of blades for simultaneously cutting each elongate filter rod into individual filter components.

In the process of cutting filter components according to the present invention, the various steps include delivering elongate filter rods from a supply hopper to a cutting drum having flutes on an outside surface of the drum arranged to receive the rods. Next, the filter rods are moved on the drum to positions against stops in the drum flutes. The filter rods are then cutting into individual filter components.

Prior to the cutting procedure, the position of the stops on the cutting drum may be adjusted depending upon the desired length of each of the individual filter components.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
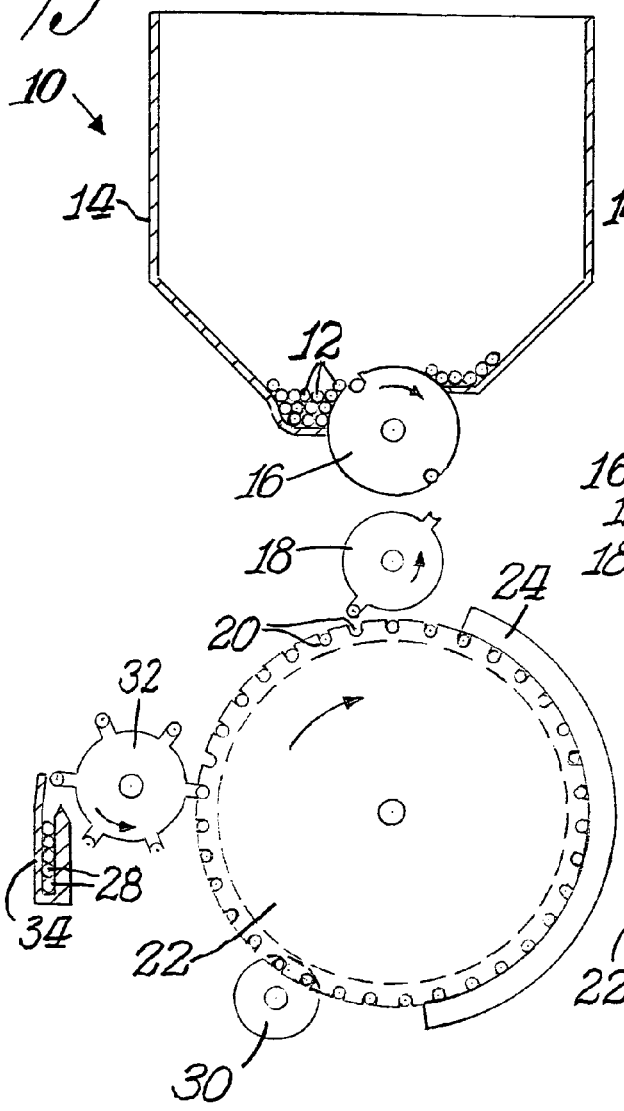
FIG. 1 is a diagrammatic front elevational view of a filter component cutting system, in accordance with the present invention, with portions broken away to illustrate interior details.
Figure 2:
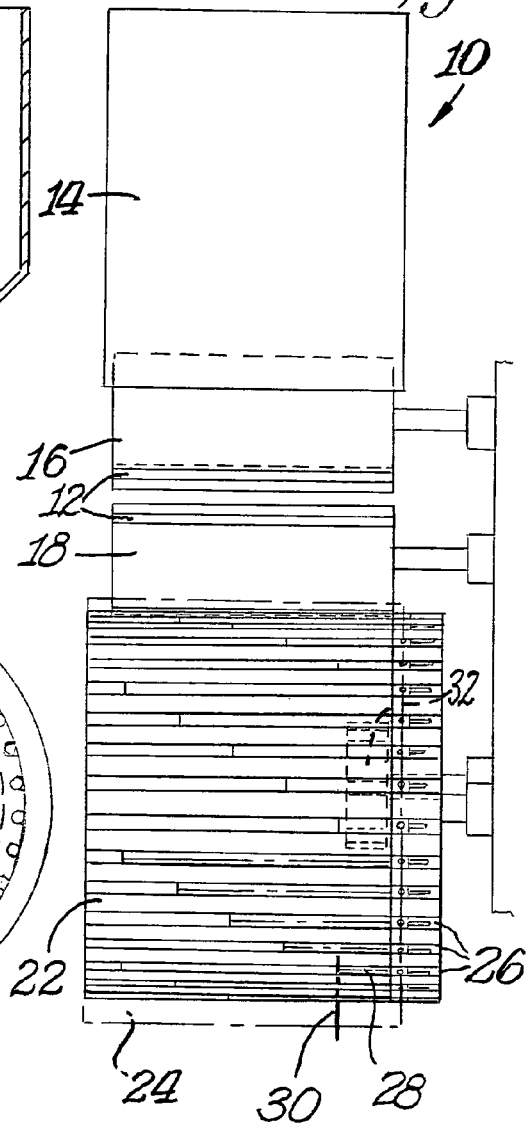
FIG. 2 is a side elevational of the filter component cutting system shown in FIG. 1.

Referring in more particularity to the drawings, FIGS. 1 and 2 illustrate a filter component cutting system 10 where elongate filter rods 12 of cellulose acetate, for example, are supplied from a hopper 14 to a pair of cooperating fluted vacuum transfer drums 16, 18. The transfer drums 16, 18 run continuously and deposit the elongate filter rods 12 onto the flutes 20 of a vacuum cutting drum 22. The ratio of the number of flutes on the transfer drums and the number of flutes on the cutting drum allow the transfer drums to run several revolutions before a pattern of depositing filter rods on the cutting drum repeats.

As the filter rods 12 rotate on the cutting drum 22 the rods pass under a cowl 24 and vacuum in the rear of the cowl draws air in from the front of the flutes which shifts the filter rods back against an adjustable stop 26 mounted in each flute 20 of the cutting drum. As an option, air jets can be used on the front of the cowl to blow against the front of the filter rods to assist the shifting of the filter rods against the adjustable stops. The position of the adjustable stops determines the length of each of the individual filter components 28 cut from the filter rods, as explained below.

As the filter rods leave the cowl 24, vacuum in the cutting drum 22 holds the filter rods in the flutes 20. The filter rods then travel through a rotating knife blade 30 which severs an individual filter component 28 from the original elongate filter rod. The cut component 28 and remaining portion of the original filter rod are still held in the flutes 20 by vacuum. As the cutting drum 22 continues to rotate, vacuum is released on the cut component 28, and the component is removed by a vacuum take-off drum 32. The take-off drum transfers the cut component to a feed vane 34, or drum (not shown) which then transfers the filter components to a filter combining operation.

The remaining portions of the original filter rods continue to rotate on the cutting drum. As they again pass under the cowl, vacuum holding them in the flutes, is released and they are once again shifted back against the adjustable stops 26 by vacuum from the rear of the cowl and possibly air jets on the front of the cowl. As they again pass the knife another group of individual components 28 is cut and later removed by the take-off drum 32. This process continues until the original filter rod has been completely cut into individual filter components 28. If the original filter rod length is not a multiple of the cut length of the filter components 28 the rod portion remaining after the last cut is rejected by an air jet.

By way of example, the cutting drum 22 and the blade 30 may be designed to cut each elongate filter rod 12 six times. The transfer drums 16, 18 deposit a filter rod in every sixth flute 20 of the cutting drum 22 and the cutting drum has thirty five flutes. The adjustable stops 26 are positioned to cut 20 mm long filter components, and the original filter rod is 122 mm long. After six revolutions of the cutting drum, six 20 mm long filter components have been cut from the original filter rod and the remaining 2 mm of each original filter rod is rejected. This leaves each flute 20 empty and ready to receive the next full length filter rod to be deposited when the flute meshes with the transfer drum 18.

Figure 3:
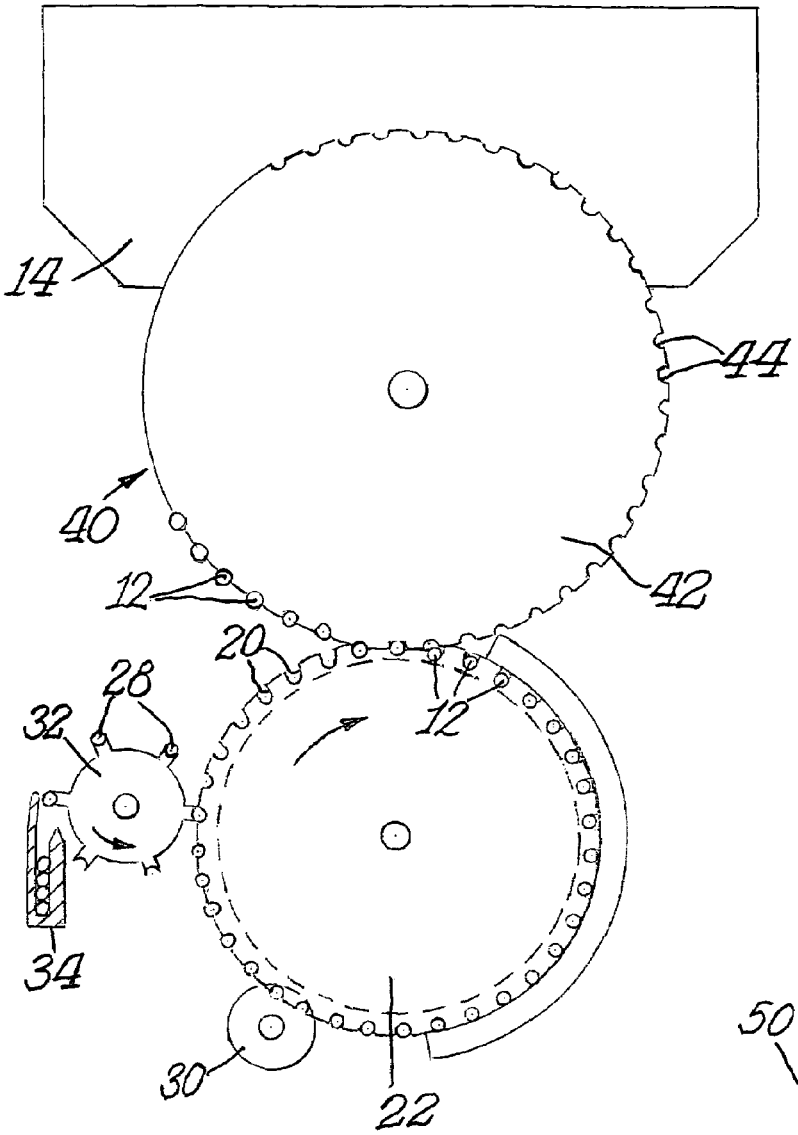
FIG. 3 is a diagrammatic front elevational view of an alternative filter component cutting system, according to the present invention.

FIG. 3 illustrates another filter component cutting system 40 similar in many respect to system 10 shown in FIGS. 1 and 2, and similar reference characters have been used to identify similar parts. In system 40 one transfer drum 42 is used, and the drum does not run continuously. The transfer drum has a diameter larger than cutting drum 22 and one revolution of the transfer drum completely fills the cutting drum with filter rods. The transfer drum 42 has flutes 44 around approximately 270 degrees of its periphery. The remaining 90 degrees is undercut. The transfer drum 42 rotates 270 degrees and completely fills the flutes 20 on the cutting drum 22. The transfer drum 42 continues to rotate slightly and then stops to place the undercut portion inline with the cutting drum 22.

The cutting drum 22 rotates multiple times to completely cut the original filter rods 12 into individual components 28. With each rotation, vacuum in the cowl 24 shifts the filter rods against the adjustable stops 26, and the blade 30 cuts the components to length. The take-off drum 32 removes the cut components in the same manner as discussed above with respect to system 10 of FIGS. 1 and 2. As the last components are removed, the transfer drum 42 rotates once again the refills the cutting drum with filter rods 12.

Figure 4:
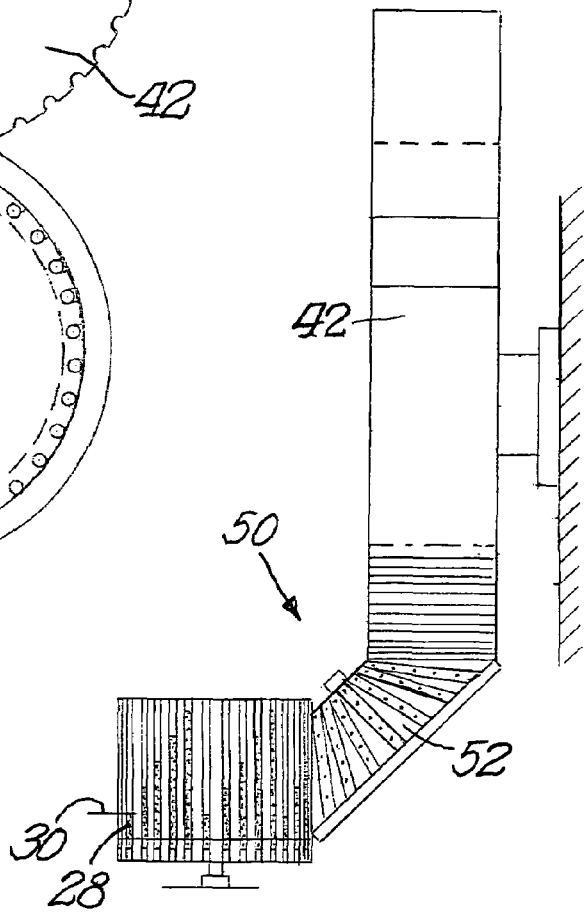
FIG. 4 is a diagrammatic side elevational view of a modified filter component cutting system similar to FIG. 3, but including a vertically oriented cutting down, according to the present invention.

As another option FIG. 4 illustrates still another filter component cutting system 50 similar in many respects to the systems 10 and 40 shown in FIGS. 1-3, and similar reference numerals are used to identify similar parts. In system 50 two transfer drums 42, 52 are used, and drum 52 is a conical/bevel drum as shown. The conical/bevel drum 52 turns the filter rods 123 vertically which allows the cutting drum 22 to be positioned in a vertical orientation. The vertical orientation of the cutting drum 22 allows gravity to assist in the shifting of the filter rods against the adjustable stops 26. The transfer drum 42 receives filter rods 12 from hopper 14 in the same manner as described above with respect to the system 40 of FIG. 3. Filter rods 12 on drum 42 are then transferred to the conical/bevel drum 52.

The adjustable stops 26 of all embodiments are intended to be manually set to a desired component cut length. As an option, these stops may be attached to a plate (not shown) which rotates with the cutting drum 22. The mechanism could then be used to change the cut length by adjusting the plate position. This allows fine tuning of the component cut length as the machine runs.

Figure 7:
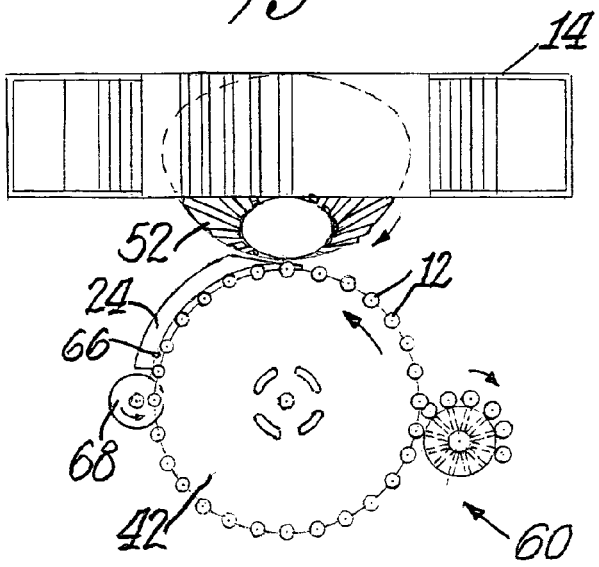
FIG. 7 is a top plan view of the filter component cutting system shown in FIGS. 5 and 6.
Figure 5:
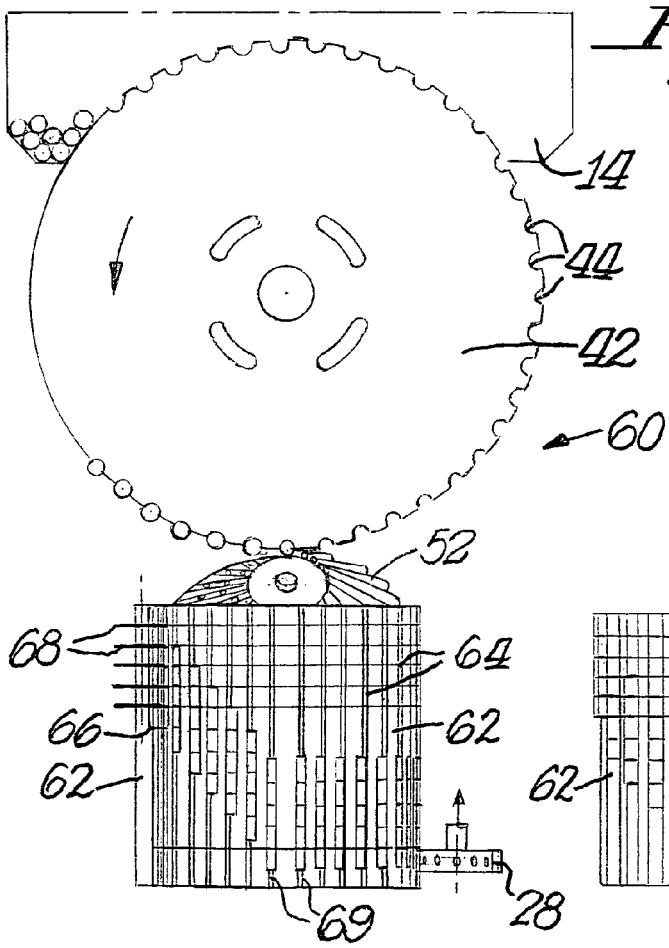
FIG. 5 is a diagrammatic front elevational view of another filter component cutting system; according to the present invention.
Figure 6:
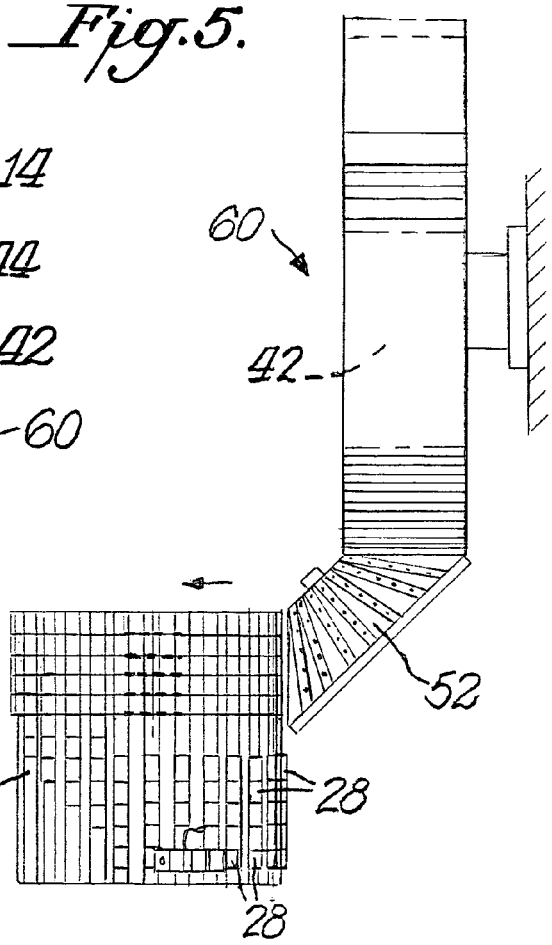
FIG. 6 is a side elevational view of the filter component cutting system shown in FIG. 5.

FIGS. 5-7 illustrate another filter component cutting system 60 similar in many respects to system 50 of FIG. 4 and similar reference characters have been used to identify similar parts. System 60 includes a longer cutting drum 62 with flutes 64. Filter rods 12 are fed to the upper portion of the cutting drum 62 by transfer drum 42 and conical/bevel drum 52. As the filters travel under the cowl 24 they are positioned by end guides 66 located between the cowl and the drum. The elongate filter rods 12 then pass through rotating cutter blades 68 which cut the filter rods into multiple filter components 28. As the cut components 28 leave the cutter blades, vacuum in the lower end of the cowl and air jets in the upper end shift the entire stack of cut components in each flute 64 down against a stop 69 in the lower portion of the drum. As the drum rotates, the lowest component in each flute 64 is removed by the take-off drum 32. The cutting drum rotates multiple times until all of the components are removed. As the last components are removed, the transfer drums 42, 52 deliver another full load of filter rods 12 to the upper portion of the cutting drum 62.

The foregoing description illustrates and describes the present invention. Additionally, the disclosure shows and describes only the preferred embodiments of the invention, but as mentioned above, it is to be understood that the invention is capable of use in various other combinations, modifications, and environments and is capable of changes or modifications within the scope of the inventive concept as expressed herein, commensurate with the above teachings and/or skill or knowledge of the relevant art. The embodiments described hereinabove are further intended to explain best modes known of practicing the invention and to enable others skilled in the art to utilize the invention in such, or other embodiments and with the various modifications required by the particular applications or uses of the invention. Accordingly, the description is not intended to limit the invention to the form or application disclosed herein. Also, it is intended that the appended claims be construed to include alternative embodiments.

By way of example, cutting system 60 shown in FIG. 5-7 may be modified to include continuously running transfer feed drums similar to those of system 10, but with the lower transfer drum being a conical/bevel drum. In this embodiment (not shown), filter rods from a hopper are supplied to the continuously running transfer drums which then deposit the filter rods on the upper fluted portion of a cutting drum such as drum 62.

The ratio of the number of flutes on the transfer drums and the number of flutes on the cutting drum allow the drums to run several revolutions before the pattern of depositing filter rods on the cutting drum repeats. As the filter rods rotate on the cutting drum, they pass under a cowl, and as the filter rods travel under the cowl they are positioned by end guides located between the cowl and the drum. The filter rods then pass through rotating knives which cut the filters into multiple components. As the cut components leave the knives, vacuum in the lower end of the cowl and air jets in the upper end shift the entire stack of cut filter rods in each flute down against a stop in the lower portion of the cutting drum. As the cutting drum rotates, the lower filter component in each flute is removed by a take-off drum. On the next revolution, the stack is again shifted down and the lowest components are removed. As explained in system 10, the ratio of the number of flutes on the vacuum transfer drums to the number of flutes on the cutting drum allows the process to run continuously.

In still another embodiment (not shown), the long cutting drum just described may be replaced with separate cutting and shifting drums. Filter rods are supplied from a hopper to the fluted vacuum transfer drums just described, and the drums run continuously to deposit filter rods on a fluted vacuum cutting drum. As the filter rods rotate on the cutting drum, they pass under a cowl, and as the filter rods travel under the cowl they are positioned by end guides located between the cowl and the drum. The filter rods then pass through rotating knives which cut the filter rods into multiple components. As the cut components leave the knives, they are transferred to a fluted shifting drum. The ratio of the number of flutes on the cutting drum and the number of flutes on the shifting drum allows the drums to run several revolutions before the pattern of depositing filter rods on the shifting drum repeats. As the cut components rotate on the shifting drum they pass under a cowl where vacuum in the lower end of the cowl and air jets in the upper end shift the entire stack of cut segments in each flute down against a stop in the lower portion of the shifting drum. As the shifting drum rotates, the lower component in each stack is removed by a take-off drum. On the next revolution the stack is again shifted down and the lowest components are removed. The ratio of the number of flutes on the cutting drum to the number of flutes on the shifting drum allows the feed process to run continuously.

Figure 8:
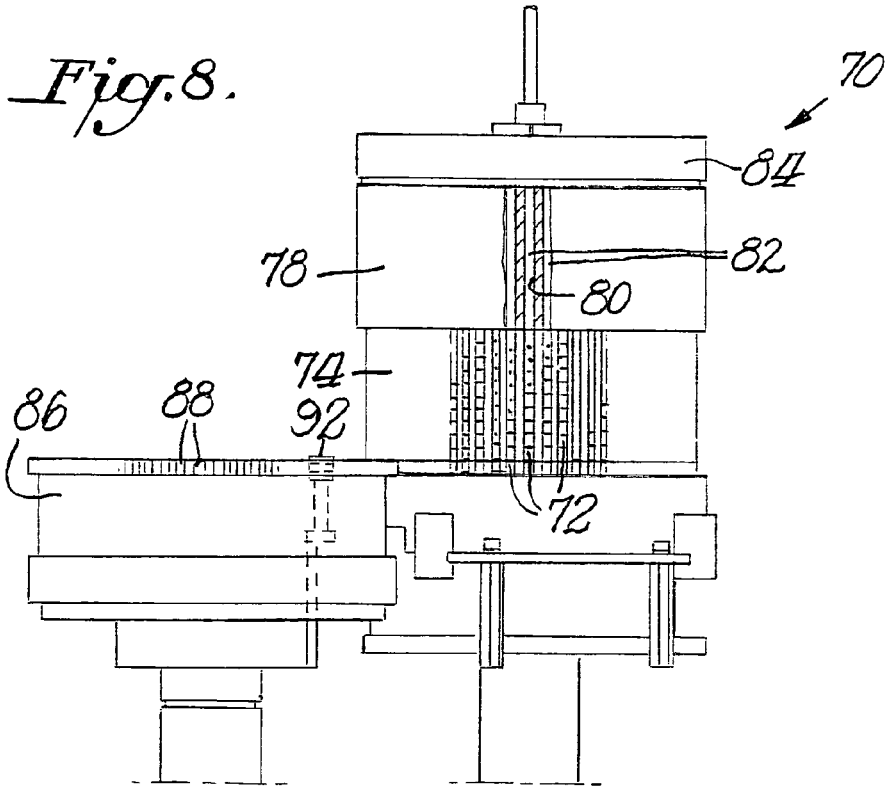
FIG. 8 is diagrammatic front elevational view of still another filter component cutting system that includes a shifting drum for handling the cut components.
Figure 9:
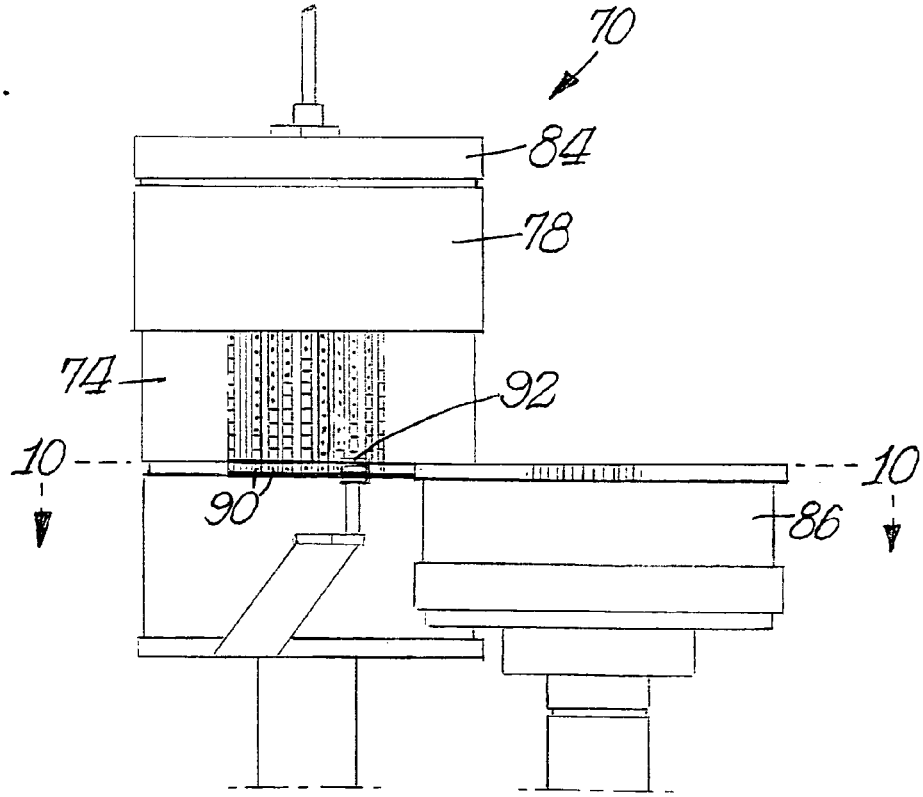
FIG. 9 is a rear elevational view of the system shown in FIG. 8.
Figure 10:
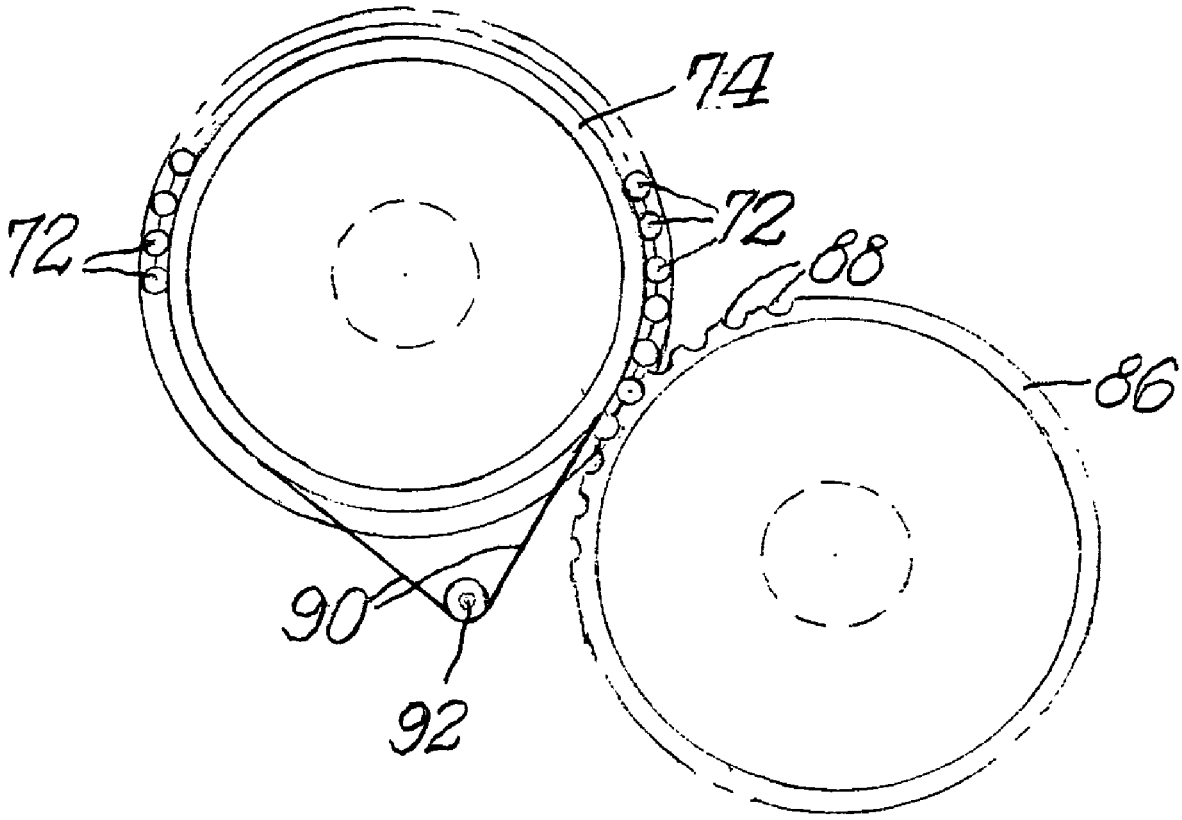
FIG. 10 is a diagrammatic sectional top plan view taken along line 10-10 of FIG. 9.

FIGS. 8-10 illustrate an embodiment 70 which is a variation of the embodiment just described in that it uses a mechanical method of shifting a stack of cut plugs 72 on a shifting drum 74 having flutes 76 on the outside thereof. The upper portion of the shifting drum 74 incorporates a gravity pin drum which comprises a separate drum 78 with vertical holes 80 that line up with the flutes 76 on the shifting drum. Headed pins 82 are positioned in each of the vertical holes 80, and these pins function as individual air cylinders. A vacuum valve 84 is located at the top of the pin drum 78, and when activated each of the headed pins 82 is individually raised by the vacuum. The vacuum is removed in the area on the shifting drum where the cut plugs 72 are to be pushed down along the flutes 76 which allows the pins 82 to push the stack of plugs 72 to the lowermost point on the flutes. An air assist may be employed, if desired. Once the stack of plugs is pushed down on the shifting drum, the vacuum is engaged to retract the push pins into the pin drum 78 thereby allowing room for another stack of plugs to be introduced onto the shifting drum. A mild vacuum is applied to the flutes 76 to retain the cut plugs 72.

At the lower end of the shifting drum 74, the individual plugs are removed one-at-a time from the shifting drum and transferred onto a dual component drum 86 having flutes 88. This transfer is accomplished by a pair of stripper belts 90 that wrap around on the bottom of the shifting drum. The belts are taken up on a grooved roller 92. The plugs 72 are sandwiched between the stripper belts 90 and the dual component drum 86 forcing each plug to be stripped from the shifting drum 74 and transferred onto the flutes 88 of the dual component drum 86.

What is claimed is:

1. A process for cutting filter components comprising the steps of:

delivering elongate filter rods from a supply hopper to a cutting drum having flutes on an outside surface of the drum arranged to receive the rods;

rotating the cutting drum;

moving the filter rods on the cutting drum against stops in each of the flutes thereof;

cutting the filter rods positioned against the stop into individual filter components all of the same length, and collecting the individual filter components one after the other.

2. A process as in claim 1 including the step of adjusting the position of the stops depending upon the desired length of each of the individual filter components.

3. A filter component cutting system comprising a supply hopper of elongate filter rods, a rotating cutting drum with spaced apart flutes on an exterior surface of the drum constructed and arranged to receive elongate filter rods, a transfer mechanism for receiving elongate filter rods from the supply hopper and delivering the rods to the flutes of the cutting drum, stop means at one end of each of the flutes on the cutting drum against which the elongate filter rods are positioned prior to being cut into individual filter components each of the same length and at least one cutter blade adjacent the cutting drum for cutting the elongate filter rods into individual filter components each of the same length as the cutting drum rotates.

4. A filter component cutting system as in claim 3 wherein the stop means is adjustable within its respective flute depending upon the desired length of the individual filter components.

5. A filter component cutting system as in claim 3 included a vacuum assist on the cutting drum for positioning the elongate filter rods against the stop means prior to being cut into individual filter components.

6. A filter component cutting system as in claim 3 wherein the transfer mechanism comprises a pair of cooperating fluted vacuum drums.

7. A filter component cutting system as in claim 6 wherein the pair of cooperating fluted vacuum drums and the cutting drum each have a horizontal axis of rotation.

8. A filter component cutting system as in claim 3 wherein the transfer mechanism comprises a single fluted vacuum drum.

9. A filter component cutting system as in claim 8 wherein the single fluted vacuum drum and the cutting drum each have a horizontal axis of rotation.

10. A filter component cutting system as in claim 3 wherein the transfer mechanism comprises a single fluted vacuum drum having a horizontal axis of rotation and a bevel transfer drum, and wherein the cutting drum rotates about a vertical axis of rotation.

11. A filter component cutting system as in claim 3 wherein the at least one cutter blade comprises a single cutting blade.

12. A filter component cutting system as in claim 3 wherein the at least one cutter blades comprises a plurality of spaced apart cutter blades for simultaneously cutting each elongate filter rod into individual filter components.

13. A filter component cutter system as in claim 12 wherein the transfer mechanism comprises a single fluted vacuum drum having a horizontal axis of rotation and a bevel transfer drum, and wherein the cutting drum rotates about a vertical axis of rotation.

* * * * *